US011241035B1

(12) United States Patent
Reeve

(10) Patent No.: US 11,241,035 B1
(45) Date of Patent: Feb. 8, 2022

(54) KIEF DIFFUSION APPARATUS AND PRODUCT

(71) Applicant: Paul Reeve, Salem, OR (US)

(72) Inventor: Paul Reeve, Salem, OR (US)

( * ) Notice: Subject to any disclaimer, the term of this patent is extended or adjusted under 35 U.S.C. 154(b) by 115 days.

(21) Appl. No.: 16/740,759

(22) Filed: Jan. 13, 2020

(51) Int. Cl.
*A24F 1/30* (2006.01)
*A24F 1/04* (2006.01)

(52) U.S. Cl.
CPC . *A24F 1/30* (2013.01); *A24F 1/04* (2013.01)

(58) Field of Classification Search
CPC ..... A24F 1/04; A24F 1/30
See application file for complete search history.

(56) References Cited

U.S. PATENT DOCUMENTS 4,142,536 A * 3/1979 DeCarlo ..... A24F 1/30 131/173
6,935,345 B2 8/2005 Carstens
8,534,296 B2 9/2013 Groff
9,848,639 B1 * 12/2017 Soares ..... A24F 1/30
10,321,714 B1 * 6/2019 Kane ..... A24F 40/50
2008/0072917 A1 * 3/2008 Lee ..... A24F 1/30 131/173

* cited by examiner

*Primary Examiner* — Eric Yaary
(74) *Attorney, Agent, or Firm* — Sanchelima & Associates, P.A.; Christian Sanchelima; Jesus Sanchelima

(57) ABSTRACT

A kief diffusion apparatus and product is disclosed herein. The smoking apparatus includes a first chamber that contains and burns a kief substance and has a single exit pipe that delivers the smoke to a second chamber, wherein the exit pipe attaches to a vertical tube having a plurality of apertures in the lower end. The aperture end of the tube is submerged in water that fills a portion of the second chamber and the mouthpiece extends from the top of the second chamber. The first chamber includes two air inlets that are directed inward and form a helical movement as the smoke is drawn from the chamber. The mouthpiece has an integral gravity seal that is hingedly mounted therein and the exit tube from the first chamber includes an integral molded handle.

10 Claims, 5 Drawing Sheets

KIEF DIFFUSION APPARATUS AND PRODUCT

BACKGROUND OF THE INVENTION

1. Field of the Invention

The present invention relates to a kief diffusion apparatus and product and, more particularly, to a kief diffusion apparatus and product that features a compressed kief form that would be ignited within a diffuser to enable highly potent cannabis smoke to be diffused an eventually inhaled by a user.

2. Description of the Related Art

Several designs for a smoking apparatus have been designed in the past. None of them, however, include a passive combustion system integrated in a smoking apparatus comprising a first chamber that contains and burns a kief substance and has a single exit pipe that delivers the smoke to a second chamber, wherein the exit pipe attaches to a vertical tube having a plurality of apertures in the lower end. The aperture end of the tube is submerged in water that fills a portion of the second chamber and the mouthpiece extends from the top of the second chamber. The first chamber includes two air inlets that are directed inward and form a helical movement as the smoke is drawn from the chamber. The mouthpiece has an integral gravity seal that is hingedly mounted therein and the exit tube from the first chamber includes an integral molded handle. Additionally, the system includes a kief product made from a combination of compressed kief and rosin oil. The system also includes another kief product that is made of a combination of bubble hash and compressed kief.

Applicant believes that a related reference corresponds to U.S. Pat. No. 6,935,345 issued for a multi-chamber smoking apparatus for generating a small bubble in a smoke-filled air stream. Applicant believes that another reference relates to U.S. Pat. No. 8,534,296 issued for a water-cooled smoking apparatus with multiple cone-shaped valves that help produce a helical smoke stream. However, the references disclosed fail to address the issue of providing an efficient method for diffusing highly potent cannabis to be effectively inhaled by a user. The present invention introduces a smoking apparatus comprising a first chamber that contains a burning kief substance that delivers the smoke from the first chamber to a second chamber. Additionally, the references fail to address the issue of providing an original kief product that is optimized for use with the smoking apparatus. The kief product may include a mixture of kief and rosin oil Another kief product may contain a combination of kief and bubble hash. The present invention addresses these issues, providing a highly efficient system to inhale highly potent cannabis not enabled by the previous disclosures.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a kief diffusion apparatus and product that provides an improved way to consume cannabis in a clean, more purified manner.

It is another object of this invention to provide a kief diffusion apparatus and product that reduces messes, waste, smoke/odors, preparation time and consumption time.

It is still another object of the present invention to provide a kief diffusion apparatus and product that allows for more accurate dosing and experimentation by a user.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
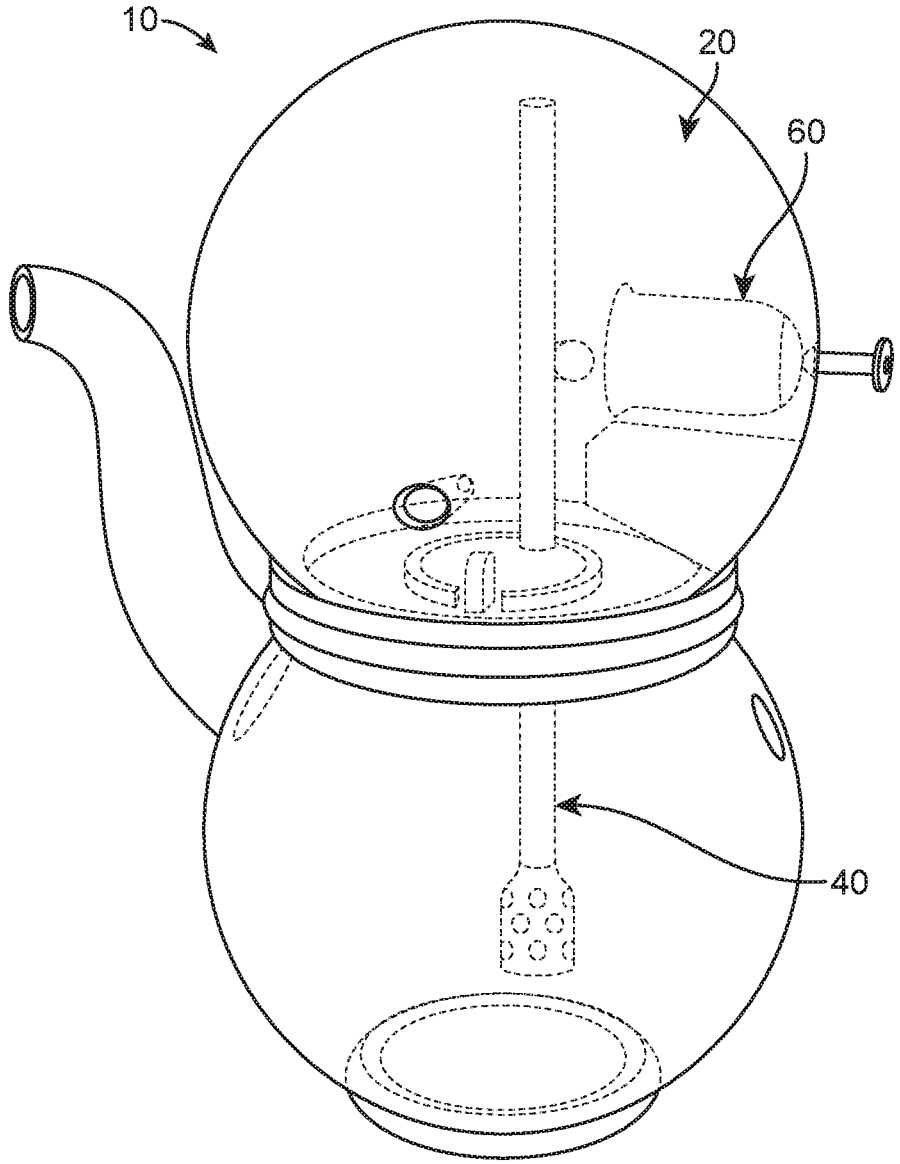
FIG. 1 represents an isometric view of kief cone diffuser system 10 having chamber assembly 20, tube assembly 40, and extinguisher assembly 60 in accordance to an embodiment of the present invention.
Figure 2:
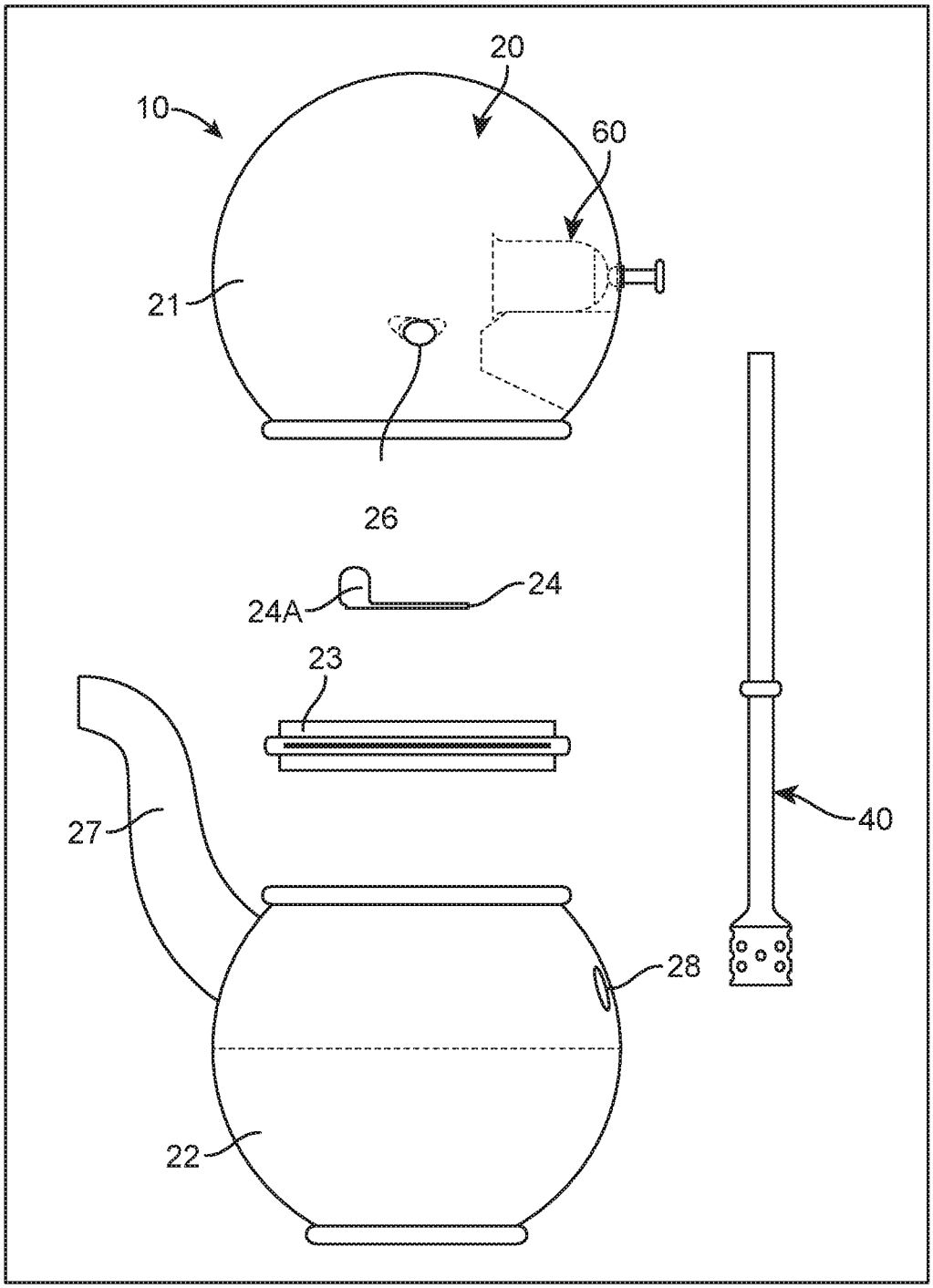
FIG. 2 shows an exploded view of kief cone diffuser system 10 in accordance to an embodiment of the present invention.
Figure 3:
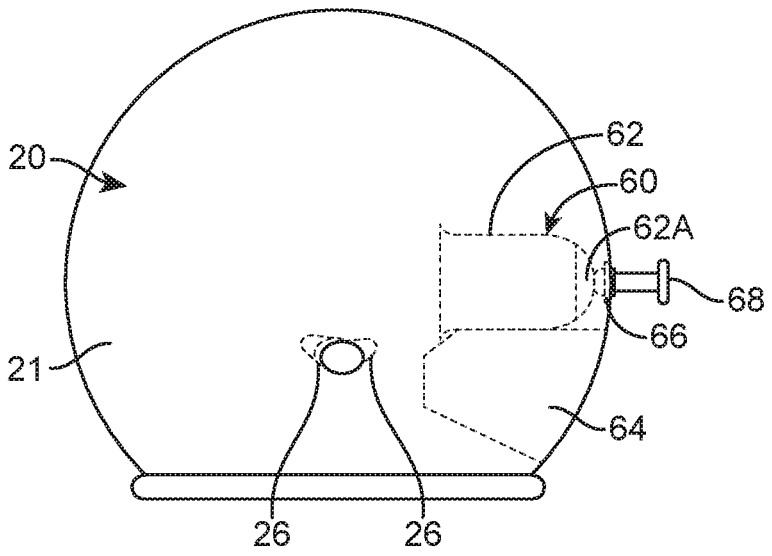
FIG. 3 illustrates an enlarged view of first chamber 21 depicting an enlarged view extinguisher assembly 60 therein in accordance to an embodiment of the present invention.
Figure 4:
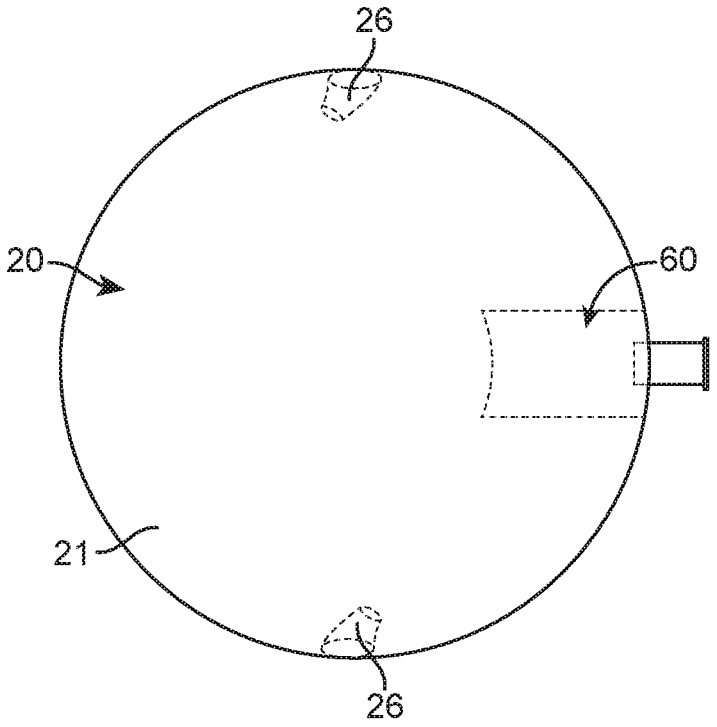
FIG. 4 is a representation of a top view of first chamber 21 depicting inlets 26 therein in accordance to an embodiment of the present invention.
Figure 5:
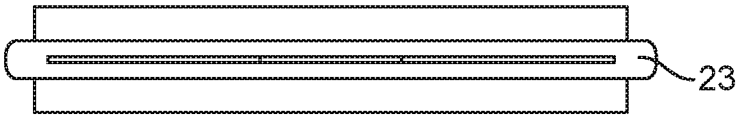
FIG. 5 shows a side view of base plate 23 in accordance to an embodiment of the present invention.
Figure 6:
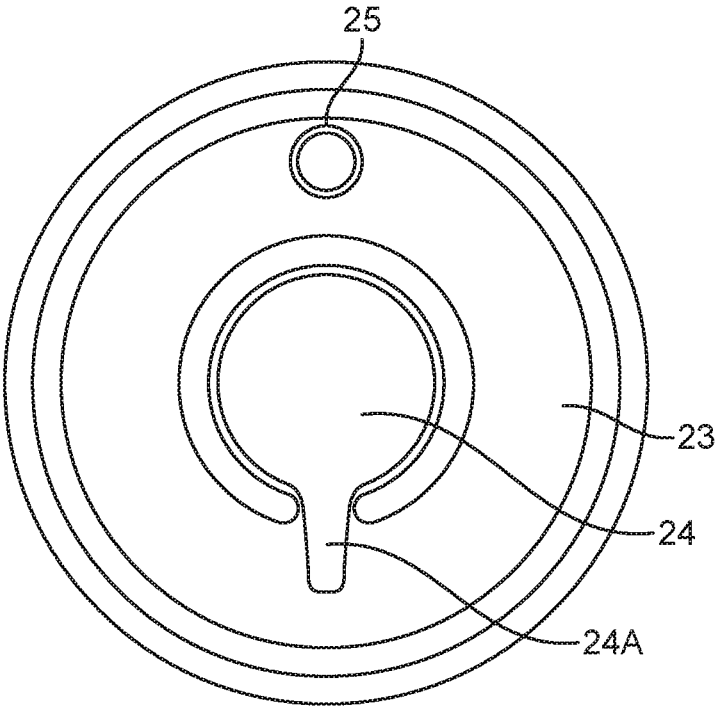
FIG. 6 illustrates a top view of base plate 23 depicting opening 25 and removable tray 24 in accordance to an embodiment of the present invention.
Figure 7:
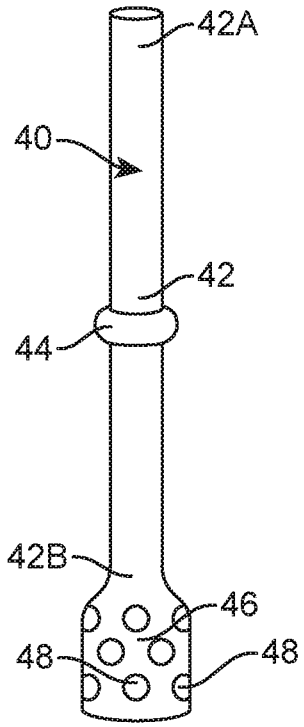
FIG. 7 represents an isometric view of tube assembly 40 in accordance to an embodiment of the present invention.
Figure 8:
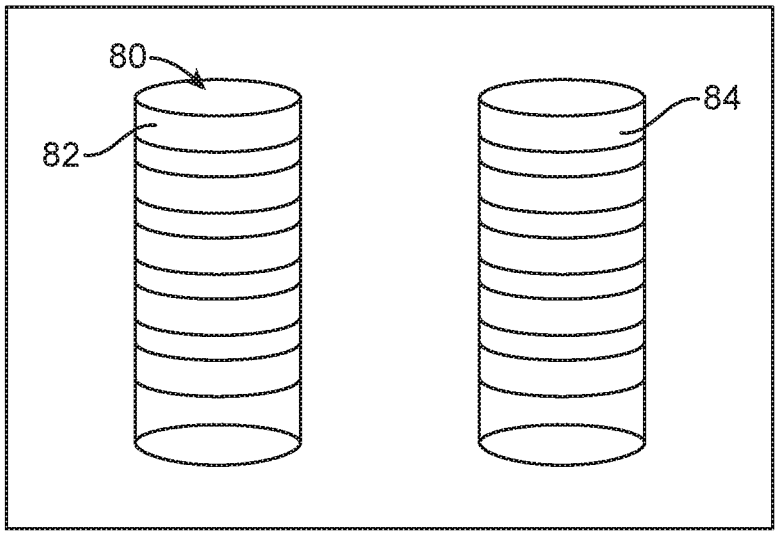
FIG. 8 shows an isometric view of kief substance 80 in accordance to an embodiment of the present invention.

Referring now to the drawings, where the present invention is generally referred to with numeral 10, it can be observed a kief diffusion apparatus 10 including a chamber assembly 20, a tube assembly 40, and an extinguisher assembly 60.

Chamber assembly 20 includes a first chamber 21 and a second chamber 22. In one embodiment, first chamber 21 and second chamber 22 may be made out of a transparent glass material. It should be understood, that any suitable material may be used for first chamber 21 and second chamber 22. Additionally, first chamber 21 and second chamber 22 may be made out of a spherical shape. Furthermore, first chamber 21 and second chamber 22 may be of the same dimension and shape. It should be understood that any combination of shape or other additional shapes may be used for first chamber 21 and second chamber 22. In one embodiment, first chamber 21 may mounted vertically on top of second chamber 22. Other embodiments may include first chamber 21 and second chamber 22 being mounted in different suitable configurations and is not limited to being vertically mounted. Additionally, first chamber 21 and second chamber 22 may be hollow therein and interconnected by a base plate 23. In one embodiment, base plate 23 includes a rubber seal surrounding an upper portion and a lower portion of base plate 23. In one embodiment, base plate 23 is circular in shape and has a suitable diameter to fit within between first chamber 21 and second chamber 22. The rubber seal may encompass an outer portion of the base plate and creates a secure connection with first chamber 21 and second chamber 22. Additionally, the rubber seal of base plate 23 may create an airtight seal to prevent outside factors from contaminating the contents within first chamber 21 and second chamber 22. Additionally, base plate 23 may include a removable tray 24 that is removable mounted to a center top end of base plate 23. In one embodiment, removable tray 24 may be a circular member that may be recessed within base plate 23. Furthermore, removable tray 24 may further include a handle 24A protruding vertically from an edge of the removable tray 24. In one embodiment, handle 24A is a "U" shaped member extending from removeable tray 24. It should be understood, other embodiments may include removable tray 24 having other variations of shapes. Additionally, handle 24A may have other shapes and is not limited to being a "U" shape as seen in the drawings. In one embodiment, removable tray 24 is configured to hold a kief substance to be burned within. Additionally, removable tray 24 facilitates for the easy replacement and use of the kief substance.

Base plate 23 may further include an opening 25 located therethrough a portion of the base plate. In one embodiment, opening 25 may be located directly next to removable tray 24 and be circular in shape. Additionally, opening 25 is configured to receive tube assembly 40 therein. First chamber 21 also includes inlets 26 located within an inner surface area. In one embodiment, inlets 26 are conical hollow members extending inwardly into first chamber 21. Inlets 26 provide an opening into first chamber 21. In one configuration, inlets 26 may cause smoke within first chamber 21 to form a helical movement as the smoke is being drawn from first chamber 21. Additionally, inlets 26 may be placed on opposite of each other in order to provide the most optimal configuration for this effect. It should be understood, any number of inlets may be included into first chamber 21. Additionally, they may be excluded if the helical shape is not desired by a user. Furthermore, other configurations of inlets may be provided. Chamber assembly 20 may further include a mouthpiece 27 provided as an integral attachment to second chamber 22. Mouthpiece 27 may be an "S" shaped hollow member extending upwardly from second chamber 22. In one embodiment, mouthpiece 27 extends upwardly from second chamber 22 and is entirely below a top end of first chamber 21. It should be understood, other configurations and shapes may be used for mouthpiece 27 and is not limited to being the shape described. Additionally, mouthpiece 27 may also include an integral gravity seal located in the attachment portion to second chamber 22. This integral gravity seal may be a hinged cover that is meant to cover an opening of the attachment portion of mouthpiece 27. The integral gravity seal will be lifted when a user inhales through mouthpiece 27. Second chamber 22 may further include a carburetor opening 28 located on a top portion of second chamber 22. In one embodiment, carburetor opening 28 is circular in shape and located at an opposite side of mouthpiece 27. Carburetor opening 28 provides a way for smoke to escape from second chamber 22 in order to prevent a dangerous increase in pressure within second chamber 22. Chamber assembly 20 provides a user with the most optimal configuration to inhale a kief substance.

Tube assembly 40 includes an elongated hollow tube 42 having a top end 42A and a bottom end 42B. In one embodiment, hollow tube 42 is a hollow cylindrical member with openings at top end 42A and bottom end 42B. Hollow tube 42 may be inserted through opening 25 of base plate 23 in order to create an internal connection between first chamber 21 and second chamber 22. In one embodiment, hollow tube 42 is entirely housed within first chamber 21 and second chamber 22. Additionally, hollow tube 42 provides a passage for the smoke that is being produced in first chamber 21 to travel down into second chamber 22. Furthermore, hollow tube 42 may further a positioning retainer 44 located in a middle portion of hollow tube 44. In one configuration, positioning retainer 44 is a ring like protrusion extending outwardly from the middle portion of hollow tube 42. Positioning retainer 44 allows hollow tube to lock in within opening 25 and rest within first chamber 21 and second chamber 22. Hollow tube 42 may further include an enlarged portion 46 located at bottom end 42B. Enlarged portion 46 may be a bell-shaped member that may be provided as an integral part to bottom end 42B. enlarged portion 46 may further include holes 48 located thereon. Holes 48 allow the smoke traveling through hollow tube 42 to be dispersed more easily. In one embodiment, second chamber 22 may be filled with water up to a predetermined level. Additionally, bottom end 42B may be submerged within the water found in second chamber 22. Tube assembly 40 provides a user with the best connection between first chamber 21 and second chamber 22.

Extinguisher assembly 60 includes a bell cover 62 placed on a platform 64 located within first chamber 21. In one embodiment, platform 64 is a substantially cubic rectangular member mounted to the inner surface of first chamber 21. Additionally, platform 64 may extend a predetermined length within first chamber 21. Furthermore, platform 64 may have a suitable shape and length to hold bell cover 62 thereon. In one embodiment, bell cover 62 is placed in a horizontal configuration thereon platform 64. Additionally, platform 64 may also include a ramp portion located on a front end of the platform. Platform 64 may be provided in a removable configuration or an integral configuration to first chamber 21. Bell cover 62 may include a metallic portion 62A located at a top end of bell cover 62. Metallic portion 62A may be a metallic shell that surrounds a portion of bell cover 62. In one embodiment, bell cover 26 is mounted flush against an inner wall of first chamber 21. Additionally, a magnetic ring 66 may be included with this inner wall in order to provide the necessary structure for bell cover 26 to be coupled to the inner wall of first chamber 21. Magnetic ring 66 may be a magnetic ring structure that is located as an integral part of first chamber 21. Metallic portion 62A is then coupled to magnetic ring 66 to create an established mounting means for bell cover 62 and first chamber 21. Extinguisher assembly 60 may further include a button 68 that is coupled within the inner portion of magnetic ring 66. Button 68 allows for a user to disengage bell cover 62 from magnetic ring 66. In one embodiment, extinguisher assembly 60 is used to stop the kief substance located within first chamber 21 to continue burning. When a user decides to stop the burning of the substance, they may then use the button in order to disengage the bell cover 62 from magnetic ring 66. Afterwards, the bell cover may then slide down platform 64 using the provided ramp portion to then land and cover removable tray 24 containing the kief substance. In one embodiment, the diameter of bell cover 62 may be a diameter that is equal to the diameter of removable tray 24. Bell cover 62 then covers the kief substance entirely and starves it of oxygen thereby preventing the substance from continuing to burn. Extinguisher assembly 60 provides a user with the most optimal configuration to stop kief substance from burning within the first chamber.

Kief diffusion apparatus 10 may further include a kief substance 80 to be used with the provided apparatus. As known in the art, kief substance 80 is a cannabis by product of tumbling that is high in THC levels. Kief substance 80 may be sativa or indica based that can be easy to smoke with minimal ash. Kief substance 80 may also ne provided with a combination of rosin oil and bubble hash. This configuration allows kief substance 80 to be flavored with all-natural oils which creates a smoke which smells and tastes like the flavor and effectively eliminates cannabis smell for the discrete consumer. In on embodiment of the present invention, kief substance 80 includes a first kief form 82 and a second kief form 84. First kief form 82 may be molded into a uniform cylindrical shape. First kief from 82 may be made of a combination of kief and rosin oil. It should be understood that any percentage of combination of kief and rosin oil may be provided for first kief form 82. In a preferred embodiment a combination of 75% kief and 25% rosin oil is used for first kief form 82. Second kief form 84 may also be molded into a uniform cylindrical shape. Additionally, second kief form 84 may be made of a combination of kief and bubble hash. It should be understood that any percentage of combination of kief and bubble hash may be used for second kief form 84. However, in a preferred embodiment, a combination of 50% kief and 50% hash is used for second kief form 84. Kief substance 80 provides a user with the optimal substance to be used for kief diffusion apparatus 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a kief diffusion apparatus, comprising:

a. a chamber assembly including a first chamber and a second chamber, wherein said first chamber and said second chamber are spherical in shape, wherein said first chamber is mounted vertically on top of said second chamber, wherein said first chamber and said second chamber are removable connected though a base plate having a rubber seal, wherein said base plate is circular in shape and includes a removable tray attached thereon, wherein said removable tray is located in the center of said base plate, wherein said base plate further includes an opening being circular in shape located on an area surrounding said removable tray, wherein said first chamber includes inlets located therein, wherein said second chamber includes a mouth piece extending upwardly from a top portion of said second chamber, wherein said second chamber further includes a carburetor opening located on said top portion of said second chamber;

b. a tube assembly including an elongated hollow tube having a top end and a bottom end, wherein said top end of said elongated hollow tube is open to allow smoke from said first chamber to travel therethrough said elongated hollow tube, wherein said elongated hollow tube includes a positioning retainer located on a middle portion of said elongated hollow tube, said elongated hollow tube further including an enlarged portion located at a bottom end, wherein said enlarged portion further includes holes located thereon, wherein said top end of said elongated hollow tube is received by said opening of said base plate; and c. an extinguisher assembly including a bell cover placed on a platform within said first chamber, wherein said cover extends inwardly within said first chamber, wherein said bell cover is placed in a horizontal position thereon said platform, wherein a distal end of said bell cover includes a metallic portion, wherein said distal end is mounted flush against an inner wall of said first chamber, wherein a magnetic ring mounted on said inner wall couples said metallic portion to said inner wall, wherein said extinguisher assembly further includes a button communicable mounted to said magnetic ring.

2. The system for a kief diffusion apparatus of claim 1 wherein said elongated hollow tube extends through said second chamber and said first chamber.

3. The system for a kief diffusion apparatus of claim 1 wherein said inlets are mounted at opposite ends from each other.

4. The system for a kief diffusion apparatus of claim 1 wherein said inlets have an inward conical shape.

5. The system for kief diffusion apparatus of claim 1 wherein said mouth piece extends upwardly from said second chamber and is entirely below a top end of said first chamber.

6. The system for a kief diffusion apparatus of claim 1 wherein said button is actuated to then allow said bell cover to entirely cover said removable tray.

7. The system for a kief diffusion apparatus of claim 1 wherein said platform further includes a ramp portion located thereon.

8. The system for a kief diffusion apparatus of claim 1 wherein said bell cover includes a diameter being equal to the diameter of said removable tray.

9. The system for a kief diffusion apparatus of claim 1 wherein said removeable tray includes a handle.

10. The system for a kief diffusion apparatus of claim 1 wherein said base plate further includes a rubber seal around an outer portion.

* * * * *